US011032659B2

(12) United States Patent
Fox et al.

(10) Patent No.: US 11,032,659 B2
(45) Date of Patent: Jun. 8, 2021

(54) AUGMENTED REALITY FOR DIRECTIONAL SOUND

(71) Applicant: INTERNATIONAL BUSINESS MACHINES CORPORATION, Armonk, NY (US)

(72) Inventors: Jeremy R. Fox, Georgetown, TX (US); Trudy L. Hewitt, Cary, NC (US); Liam S. Harpur, Skerries (IE); John Rice, Tramore (IE)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/105,878

(22) Filed: Aug. 20, 2018

(65) Prior Publication Data

US 2020/0059748 A1 Feb. 20, 2020

(51) Int. Cl.

| | |
|---|---|
| ***H04S 7/00*** | (2006.01) |
| ***H04R 1/40*** | (2006.01) |
| ***H04R 3/12*** | (2006.01) |
| ***H04R 5/04*** | (2006.01) |
| ***H04S 3/00*** | (2006.01) |
| ***H04R 5/02*** | (2006.01) |

(52) U.S. Cl.

CPC ..... *H04S 7/303* (2013.01); *H04R 1/403* (2013.01); *H04R 3/12* (2013.01); *H04R 5/02* (2013.01); *H04R 5/04* (2013.01); *H04S 3/008* (2013.01); *H04S 2400/01* (2013.01); *H04S 2400/11* (2013.01)

(58) Field of Classification Search

CPC .... G06F 3/165; G06F 3/167; G06F 17/30061; G06F 3/011; G06F 3/04815; G06F 2217/82; G06T 19/006; G06T 15/205; G06K 9/00671; H04S 7/302; H04S 7/303; H04S 3/008; H04S 2400/01; H04S 2400/11; H04R 5/02; H04R 5/04; H04R 1/403; H04R 3/12

USPC ..... 381/17, 310, 56, 61, 104, 107, 303; 345/419, 633; 700/94; 463/31

See application file for complete search history.

(56) References Cited

U.S. PATENT DOCUMENTS

| | | | |
|---|---|---|---|
| 5,668,884 | A | 9/1997 | Clair, Jr. et al. |
| 6,229,899 | B1 | 5/2001 | Norris et al. |

(Continued)

OTHER PUBLICATIONS

Smith, A., "CES 2018: Samsung's 'directional speaker' aims to replace headphones," [online] What Hi-Fi? © Future Publishing Limited, Jan. 2, 2018, retrieved from the Internet: <https://www.whathifi.com/news/ces-2018-samsungs-directional-speaker-aims-to-replace-headphones#IwwYfEK2mlammDCV.99>, 4 pg.

(Continued)

*Primary Examiner* — Norman Yu

(74) *Attorney, Agent, or Firm* — Cuenot, Forsythe & Kim, LLC

(57) ABSTRACT

Providing a user with an augmented sound experience include receiving an identification an object within an environment proximate a user; determining a location of the object within the environment; determining a current location of the user within the environment; and causing a speaker array to produce a sound based on the current location of the object and the current location of the user such that the sound appears, relative to the current location of the user, to originate from the current location of the object.

20 Claims, 3 Drawing Sheets

(56) References Cited

U.S. PATENT DOCUMENTS

| | | | | |
|---|---|---|---|---|
| 8,577,065 | B2 | 11/2013 | Lau | |
| 9,420,392 | B2 | 8/2016 | Kuehne et al. | |
| 9,578,439 | B2 | 2/2017 | Kim et al. | |
| 2003/0007648 | A1 | 1/2003 | Currell | |
| 2009/0161880 | A1 | 6/2009 | Hooley et al. | |
| 2010/0034404 | A1 | 2/2010 | Dent | |
| 2010/0042925 | A1 | 2/2010 | Demartin et al. | |
| 2012/0206452 | A1* | 8/2012 | Geisner | G02B 27/017 345/419 |
| 2013/0121515 | A1 | 5/2013 | Hooley et al. | |
| 2015/0211858 | A1* | 7/2015 | Jerauld | A61F 9/08 701/541 |
| 2016/0212538 | A1* | 7/2016 | Fullam | G06K 9/0057 |
| 2017/0153866 | A1* | 6/2017 | Grinberg | G02B 27/017 |
| 2018/0349088 | A1* | 12/2018 | Leppanen | G06F 3/011 |

OTHER PUBLICATIONS

Woodford, C. "Directional loudspeakers," [online] Explain That Stuffim Hybe 28, 2018, retrieved from the Internet: (https://www.explainthatstuff.com/directional-loudspeakers.html>, 10 pg.

"Watson Visual Recognition," [online] IBM Corporation [retrieved Aug. 20, 2018] retrieved from the Internet: <https://www.ibm.com/watson/services/visual-recognition/>, 4 pg.

"Graphics—Ball to Ball Collision—Detection and Handling," [online] Stackoverflow.com, [retrieved Aug. 20, 2018] retrieved from the Internet: <https://stackoverflow.com/questions/345838/ball-to-ball-collision-detection-and-handling#>, 3 pg.

"The Android mini game source code snooker billiards game project you take documents," [online] www.bvbcode.com © 2011 [retrieved Aug. 20, 2018], retrieved from the Internet: <http://www.bvbcode.com/code/p97emltd>, 5 pg.

"How to tune your speakers using Trueplay," [online] Sonos. Inc. © 2004-2018 [retrieved Aug. 20, 2018], retrieved from the Internet: <https://support.sonos.com/s/article/3251?language=en_US>, 4 pg.

"New Digital Audio Projectors Spawning Chip Opportunities Says In-Stat," [online] Business Wire, Inc. © 2018, May 10, 2005, retrieved from the Internet: <https://www.businesswire.com/news/home/20050510005178/en/New-Digital-Audio-Projectors-Spawning-Chip-Opportunities>, 2 pg.

Gibbs, S., "Dolb Atmos: Hollywood's 3D sound now ready for home cinemas | Gechnology," [online] The Guardian, Aug. 15, 2014, retrieved from the Internet: <https://www.theguardian.com/technology/2014/aug/15/dolby-home-cinema-audio-gravity-alfonso-cuaron-atmost>, 4 pg.

Naef, M. et al., "Spatialized audio rendering for immersive virtual environments," In Proc. of the ACM Symposium on Virtual Reality Software and Technology, Nov. 11, 2002, pp. 65-72.

Vaananen, R., "User Interaction and Authoring of 3D Sound Scenes in the Carrouso EU project," Audio Engineering Society Convention 114, Paper 5764, Mar. 22-25, 2003, 9 pg.

* cited by examiner

AUGMENTED REALITY FOR DIRECTIONAL SOUND

BACKGROUND

The present invention relates to augmented reality systems, and more specifically, to injecting directional sound into an augmented reality environment.

With the proliferation of virtual reality, or augmented reality, there are more and more applications using augmented sound to enhance the virtual experience. Directional speakers have been developed that will continue to become more commonplace. In operation, directional speakers use two parallel ultrasonic beams that interact with one another to form audible sound once those beams hit one or more objects. This interaction can be thought of as bouncing sound off of the objects such that the sound is perceived to be originating from a particular location in a user's present physical environment.

SUMMARY

A method includes receiving, by a computer, an identification an object within an environment proximate a user; determining, by the computer, a location of the object within the environment; determining, by the computer, a current location of the user within the environment; and causing, by the computer, a speaker array to produce a sound based on the current location of the object and the current location of the user such that the sound appears, relative to the current location of the user, to originate from the current location of the object.

A system includes a processor programmed to initiate executable operations. In particular the executable instructions include receiving an identification an object within an environment proximate a user; determining, by the computer, a location of the object within the environment; determining a current location of the user within the environment; and causing a speaker array to produce a sound based on the current location of the object and the current location of the user such that the sound appears, relative to the current location of the user, to originate from the current location of the object.

A computer program product includes a computer readable storage medium having program code stored thereon. In particular, the program code executable by a data processing system to initiate operations including: receiving, by the data processing system, an identification an object within an environment proximate a user; determining, by the data processing system, a location of the object within the environment; determining, by the data processing system, a current location of the user within the environment; and causing, by the data processing system, a speaker array to produce a sound based on the current location of the object and the current location of the user such that the sound appears, relative to the current location of the user, to originate from the current location of the object.

DETAILED DESCRIPTION

Figure 1:
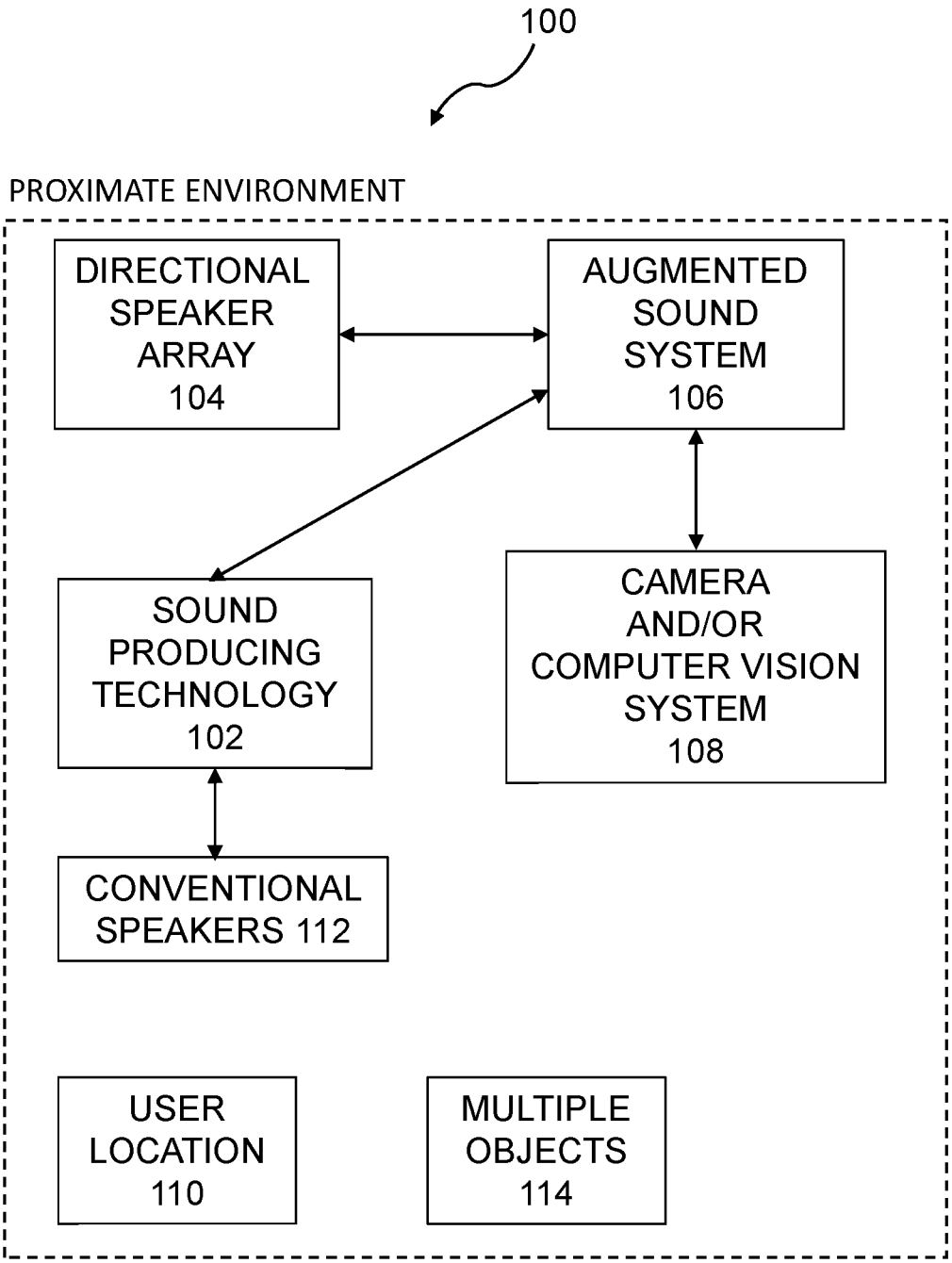
FIG. 1 is a block diagram illustrating an example of an environment in which augmented sounds can be provided in accordance with the principles of the present disclosure.

As defined herein, the term "responsive to" means responding or reacting readily to an action or event. Thus, if a second action is performed "responsive to" a first action, there is a causal relationship between an occurrence of the first action and an occurrence of the second action, and the term "responsive to" indicates such causal relationship.

As defined herein, the term "data processing system" means one or more hardware systems configured to process data, each hardware system including at least one processor programmed to initiate executable operations and memory.

As defined herein, the term "processor" means at least one hardware circuit (e.g., an integrated circuit) configured to carry out instructions contained in program code. Examples of a processor include, but are not limited to, a central processing unit (CPU), an array processor, a vector processor, a digital signal processor (DSP), a field-programmable gate array (FPGA), a programmable logic array (PLA), an application specific integrated circuit (ASIC), programmable logic circuitry, and a controller.

As defined herein, the term "automatically" means without user intervention.

As defined herein, the term "user" means a person (i.e., a human being). The terms "employee" and "agent" are used herein interchangeably with the term "user".

With the proliferation of virtual reality, or augmented reality, there are more and more applications using augmented sound to enhance the virtual experience. Directional speakers have been developed that will continue to become more commonplace. In operation, directional speakers use two parallel ultrasonic beams that interact with one another to form audible sound once those beams hit one or more objects. This interaction can be thought of as bouncing sound off of the objects such that the sound is perceived to be originating from a particular location in a user's present physical environment. Directional speaker arrays are produced in a variety of different configurations and one of ordinary skill will recognize that various combinations of these configurations can be utilized without departing from the intended scope of the present disclosure.

The ultrasonic devices achieve high directivity by modulating audible sound onto high frequency ultrasound. The higher frequency sound waves have a shorter wavelength and thus do not spread out as rapidly. For this reason, the resulting directivity of these devices is far higher than physically possible with any loudspeaker system. Thus, in accordance with the principles of the present disclosure, directional speaker arrays are preferred over systems consisting of multiple, dispersed speakers located in the walls, floor, and ceilings of a room.

Example sound technologies that have recently proliferated for consumers include conversational digital assistants (e.g., Artificial intelligence (AI) assistants), immersive multimedia experiences (such as, for example, surround sound) and augmented/virtual reality environments. Embodiments in accordance with the principles of the present disclosure contemplate utilizing these example sound technologies as well as other, similar technologies. As described below, these sound technologies are improved by using augmented sound to enhance a user's experience. In particular, directional injection of augmented sound is used to enhance the user experience through learned bounce associations of an object.

As an example, using an artificial intelligence (AI) home assistant, the present system may want to add an augmented sound to an object. In other words, the present system wants the augmented sound to appear (from the perspective of a user) to come from a nearby object. The nearby object can be another user, a physical object, or a general location within the user's present environment. The present system can use the directional speaker arrays described above to bounce sound off objects in a manner that it appears to come from the desired nearby object.

Initially, the present multidirectional speaker system operates in an "investigation mode" to determine bounce points in the proximate environment, according to an embodiment of the present invention. Microphones or similar sensors are dispersed in the proximate environment to identify the apparent source of a sound in an embodiment. Technologies exist that can create a "heat map" of a received sound that, for example, depicts the probabilistic likelihood (using different colors for example) that the received sound emanated from a particular position in the present environment. One of ordinary skill will recognize that there are other known technologies for automatically determining a distance and relative position of a particular sound source relative to where the sound is received. Utilizing these technologies, the present system tests many different bounce patterns from a directional speaker array to discover which patterns result in a sound being received at location A that is perceived by a user at A to be originating from location B. The "investigation mode" can include identifying and storing records of many different locations for the receiving of sounds and for the originating of those sounds.

Once the investigation mode is complete, the above identified sound technologies (e.g., AI assistant, VR, etc.) cause augmented sound to be provided in an embodiment of the present invention. When an AI assistant, for example, wants it to appear that from the perspective of a user that a sound came from a particular object/user/location in the proximate environment, the AI assistant searches information discovered during the investigation mode to determine an appropriate bounce pattern and drives the directional speaker array based on the bounce pattern that will result in the user perceiving the sound as originating at the particular object/user/location. Accordingly, as used herein the term bounce pattern" can refer to a pattern that results from an operational setting, or selection of elements, of the directional speaker array. In a virtual reality (VR) or augmented reality system, the producer of multimedia data or the present system can attach further information to the different bounce patterns. As explained more fully below, a sound can be assigned or labeled as being a particular "category" of sound or a particular "type" of sound. For example, all sounds that are Category_A sounds may be expected to appear to originate from a first location while all sounds that are Category_B sounds are expected to appear to originate from a second location.

FIG. 1 is a block diagram illustrating an example of an environment in which augmented sounds can be provided in accordance with the principles of the present disclosure. The proximate environment 100 can be that surrounding a user that can hear sounds produced by either the present augmented sound system 106 or conventional speakers 112. Furthermore, the proximate environment 100 can include the area around the user in which the sound producing technology 102 is being operated. As mentioned above, the sound producing technology 102 can be a surround sound system, a virtual reality system, an augmented reality system, and an AI assistant. Additionally, the sound producing technology can include DVD and BLUE-RAY players, immersive multimedia devices, computers, and similar devices.

The technology 102 communicates with the augmented sound system 106 to provide a trigger, or instruction, that the augmented sound system 106 then uses to drive the directional speaker array 104. As mentioned above, the proximate environment can include multiple objects 114 that the directional speaker array can bounce ultrasonic signals off of. Similarly, there may be a desire to bounce those signals in such a manner as to cause the sound reaching a user location 110 to appear to be emanating from a current location occupied by a particular one of those multiple objects 114. In some instances, the objects can be objects located in a room such as a table, furniture, fixtures and can also include the walls, floor and ceiling of the environment 100.

Also, present is a camera and/or computer vision system 108. Embodiments in accordance with the present disclosure contemplate a camera or image capturing device could be used to provide one or more images of the proximate environment 100 to a computer vision system that is part of the augmented sound system 106 or is a separate system 108. As explained more fully below, the computer vision system 108 recognizes various objects in a room and their location from a predetermined origin. For example, the camera can be considered to be an origin for a Cartesian coordinate system such that a respective position of a user's current location 110 and the location of the multiple objects 114 can be expressed, for example, in (x, y, z) coordinates.

Figure 2:
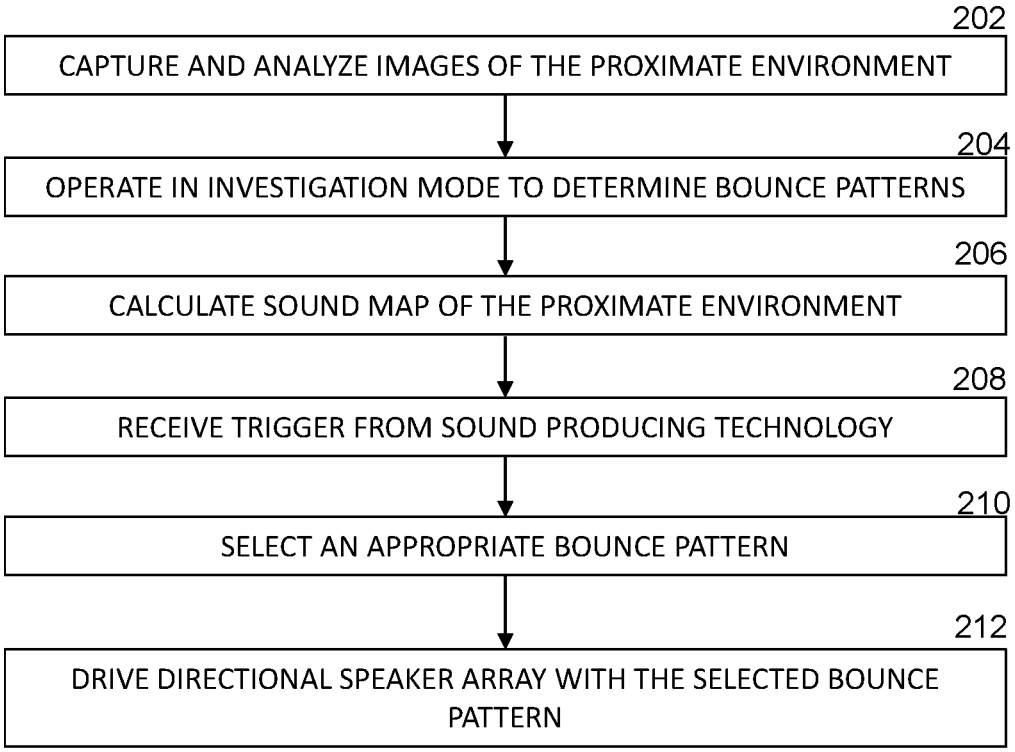
FIG. 2 illustrates a flowchart of an example method of providing augmented sound in accordance with the principles of the present disclosure.

FIG. 2 illustrates a flowchart of an example method of providing augmented sound in accordance with the principles of the present disclosure. In step 202, images of the proximate environment are captured, for example by a camera or other image acquisition device, and analyzed in order to determine what objects are present in the proximate environment and their respective locations. The computer vision system 108 can calculate a distance from the image capturing device to an object using time-of-flight cameras, stereo imaging, ultrasonic sensing, or calibration objects that are moved to various locations. In this step, the computer vision system can present a user with a list of all the objects that were identified (e.g., door, window, table, iPad, toy, chair, food, couch, etc.). The user can then be permitted to eliminate objects from the list if they desire.

As for storing this information, one of ordinary skill will recognize that a variety of functionally equivalent methods may be used without departing from the scope of the present disclosure. As an example, an "objects" look-up table could be created by the computer vision system 108 and/or the augmented sound system 106 in which each entry is a pair of values comprising an object label (e.g., door) and a location (e.g., (x,y,z) coordinates).

The computer vision system 108 can perform the image analysis to create a set of baseline information about objects that are relatively stationary but the analysis can also be performed periodically, or in near real-time, so that current information for objects such as a user's location or a portable device (e.g., iPad) can be maintained.

In addition, in step 204, the present system can be operated in an investigation mode or discovery mode to determine various bounce patterns. As mentioned above, there are various technologies available to perform this step. One additional approach may be to provide a user an app for a mobile device that can help collect the desired information. The present system can direct the user to move about the proximate environment and, using the microphone of the mobile device, the app listens for a sound that the augmented sound system produces. As an example, the augmented sound system may start with a) a selected pair of elements of the directional speaker array as an initial bounce pattern, b) a particular object (or an object's location), and c) a current location of the user of the mobile device who is using the app. The augmented sound system 106 can vary the bounce pattern until a bounce pattern is identified that creates the appearance that the sound is originating from the particular object. The bounce pattern can also include an amplitude component to account for a distance from the user's location and the object's location. The augmented sound system 106 utilizing the app can direct the user to different locations and the process repeated. The process can then select a different object and repeat the entire process for all of the objects and all of the locations in the proximate environment.

The information collected from the app can have various levels of granularity without departing from the scope of the present disclosure. In other words, it may not be necessary to "map" the proximate environment on the scale of millimeters or centimeters. Rather, the present system may operate more generally such that it is sufficient that the sound appear to originate (from the perspective of the user) from the desired one of the 16 compass directions (N, NNE, NE, ENE, E, ESE, SE, SSE, S, SSW, SW, WSW, W, WNW, NW, and NNW). Additionally, if the sound producing technology is, for example, a home entertainments system in which the user is likely to be in only one or two locations (e.g., a couch or chair), then the augmented sound system 106 can investigate, or discover, bounce patterns related to only those locations. This assumption reduces the amount of information collected, and the time to do so, but does not account for a mobile user when determining how to produce augmented sounds.

As one example, the augmented sound system could, for each identified object in the proximate environment, create and store a data object/structure that resembles something like:

```
door_Speaker_Selection {
        (9, 5, 6) , SpeakerPair12;
        (10, 0, 10) , SpeakerPair6;
        (45, 8, 6) , SpeakerPair10;
        ...
{
```

The first entry in the above example data structure conveys that if the user's current location is at (9, 5, 6), then the augmented sound system 106 activates SpeakerPair12 for the directional speaker array. Driving the directional speaker array in this manner will result in sound that appears to be coming from the direction of the door. If a user's current location in the proximate environment does not correspond exactly to one of the locations in the above data structure, then the augmented sound system 106 may use the entry that is closest to the user's current location instead.

Ultimately, in step 206, the image analysis information and the discovery mode information can be combined by the augmented sound system 106 in such a way as to create a "sound map" of the proximate environment. The sound map correlates the various pieces of information to allow the augmented sound system to recognize how to respond to a command, or trigger, for a particular sound to be produced by the directional speaker array so that the sound, relative to the user's current location is perceived to be originating from a desired object. In its most general sense, the sound map associates for a theoretical sound source location within the environment an operational mode of the speaker array that will result in a sound being produced that will be perceived, relative to a theoretical sound receiving location, as originating from the theoretical sound source location. The map contains such information for a plurality of theoretical sound source locations and a plurality of theoretical sound receiving locations.

Continuing with FIG. 2, a sound producing technology (e.g., AI assistant, entertainment system, etc.) can send a request to the augmented sound system 106, where it is received in step 208. Such a request can be sent, for example, via a wireless network, BLUETOOTH, or other communication interface. The request can include a variety of information utilizing a predetermined protocol or format. As an example, a request could beneficially include:

```
{ Sound_Request : {
        source (e.g., AI assistant, movie, etc.);
        label (e.g., door knock, voices, footsteps etc.);
        sound_data (e.g., MP3 stream, ogg file, etc.);
        object (e.g., door, table, etc.);
        time (e.g., x seconds, etc.); }
}
```

Of course, other information may be included as well or some of the above information may be omitted. While many of the entries in the above, example data structure are self-explanatory, the "object" entry can include a list of objects in a preferred order. The technology sending the request may not have foreknowledge of a particular proximate environment in which it may be deployed. Thus, to account for the potential absence of a preferred object being present, the "object" entry can specify one or more alternative objects. The system may also use a default object (or location) if none of the objects in the entry are present in the proximate environment. The "time" entry can specify a future time as measured from an agreed-upon epoch between the sound technology (e.g., AI assistant) and the augmented sound system 106. In some instances, there is no reason for a delay such that the value for this entry could be set to "0" or the entry omitted altogether.

Based on the request, the augmented sound system 106 can select an operational mode to drive the directional speaker array in step 210 to produce an appropriate bounce pattern. In an example, the received request from an entertainment system, for example, can trigger the augmented sound system to determine that the preferred object is "the door" and the time is, for example, 7.75 seconds from the start of the present DVD-chapter. The augmented sound system 106 determines a user's present location and then finds an entry in the above example "door_Select_Speaker" data structure in order to identify an operational mode (e.g., SpeakerPair12) to produce an appropriate bounce pattern.

As described, the camera and computer vision system 108, can monitor the proximate environment in near real-time so that a user's current location can be identified. If, for example, there are multiple users in an environment, the computer vision system 108 can determine a center of mass for the multiple of users to be used as the "user's location". Thus, in step 212, at the specified time, the augmented sound system 106 can drive the directional speaker array to produce the selected bounce pattern using the sound data provided in the request. When this happens, the user will perceive that the sound is originating from the direction of the door.

As mentioned above, sounds can be organized according to "type" or "category". For example, all sounds that are Category_A sounds may be expected to appear to originate from a first location while all sounds that are Category_B sounds are expected to appear to originate from a second location. Using the above, example data structure, a "door knock" might be a "type" or "category" and the augmented sound system 106 may have the intelligence to have that sound appear to originate from a door even if not explicitly instructed. Furthermore, the sound of "footsteps" may not be produced by the augmented sound system 106 relative to any object but, instead, are produced by the augmented sound system 106 to appear to originate from a direction relative to the user's current location. In this way, the augmented sound system 106 will produce personalized sound events based on the current environment proximate to a user such that the similar augmented sound system in a similarly sized room will provide different sound experiences for one user as compared to another user depending on the actual objects present within each user's respective environment.

In the above-described example, the operation of the augmented sound system 106 relies mainly on static information about the objects in the proximate environment. However, embodiments in accordance with the principles of the present disclosure also contemplate more dynamic information. The camera and computer vision system 108 may maintain current information about objects in the proximate environment. The camera, for example, can be part of a laptop or other mobile device that is capturing image data about the proximate environment in near real-time. Thus, the system can also be used, for example, by an AI assistant to locate an object (e.g., toy) that has been moved.

When the AI assistant is asked, for example, "where is my teddy bear?" The AI assistant sends a request to the augmented sound system 106 to generate a spoken response. The augmented sound system 106 is provided with a current location of the "teddy bear" relative to a closest identified object and then, based on the user's current location, identifies a bounce pattern that will result in the sound appearing to originate from that object. The AI assistant can then create an appropriate response such as "I am over here behind the couch." Sound data to effect such a response is provided to the augmented sound system 106 by the AI assistant and the augmented sound system 106 uses the selected bounce pattern to produce a sound that appears to be originating from the couch.

Alternatively, if greater precision is desired or the "teddy bear" is not near an identified object, the sound map of an environment can include various "source coordinates" and also "receiving coordinates". The "source coordinates" are not necessarily associated with any particular object during the investigation or discovery stage described earlier. In this example, the current location of the "teddy bear" is determined by the computer vision system 108 and the augmented sound system 106 selects the closest one of the "source coordinates" as where the sound should appear to originate from. Based on the user's current location a bounce pattern for the teddy bear's current coordinates is selected by the augmented sound system 106 so that the produced sound appears to be generated from the teddy bear, or nearby.

One of ordinary skill will recognize that the presently described augmented sound system 106 can include additional features as well. For example, the augmented sound system 106 can determine a distance from a user's current location to the object from which the sound is desired to originate. Based on that distance, the augmented sound system 106 can increase or decrease a volume of the sound. Additionally, the background noise level in the proximate environment can be used by the augmented sound system 106 to adjust a volume level. Furthermore, an AI assistant, for example, can use the augmented sound system 106 to provide augmented sound that interacts with the current environment of a user and the objects within that environment. Rather than simply asking a user, for example, to close a door, the AI assistant can produce that request so that the request appears to originate from the door. Thus, if the AI assistant (or other sound producing technology) is providing sound that references an object within the proximate environment, that sound can be augmented by appearing to originate from the referenced object itself. As used herein, when a sound "originates" from an object, it is meant that a user perceives at their present location that the sound originated from a location nearby the object's location or in that direction.

In one alternative where there are multiple devices within an environment that may have speakers, the directional speaker array may not be utilized. The computer vision system 108 identifies the devices and their current locations. The augmented sound system 106 can then project sound through a device close to an object to make it appear that the sound is originating from that object.

In additional embodiments, the present system can include additional sensors that monitor the sounds being produced by the augmented sound system 106. The sensors provide feedback information about how well the sound intended to be perceived as originating from an object fulfills that intention. For example, the objects originally present in a proximate environment may have changed from when an initial sound map was generated. The augmented sound system 106 can modify its initial sound map based on the feedback information to reflect how the directional speaker array should be controlled in the current proximate environment. Furthermore, other speakers may be available that the augmented sound system can use to produce acoustic signals that, in combination with the signals from the directional speaker array, produce a perception at the user's location that a sound is originating from a particular object in the environment.

Figure 3:
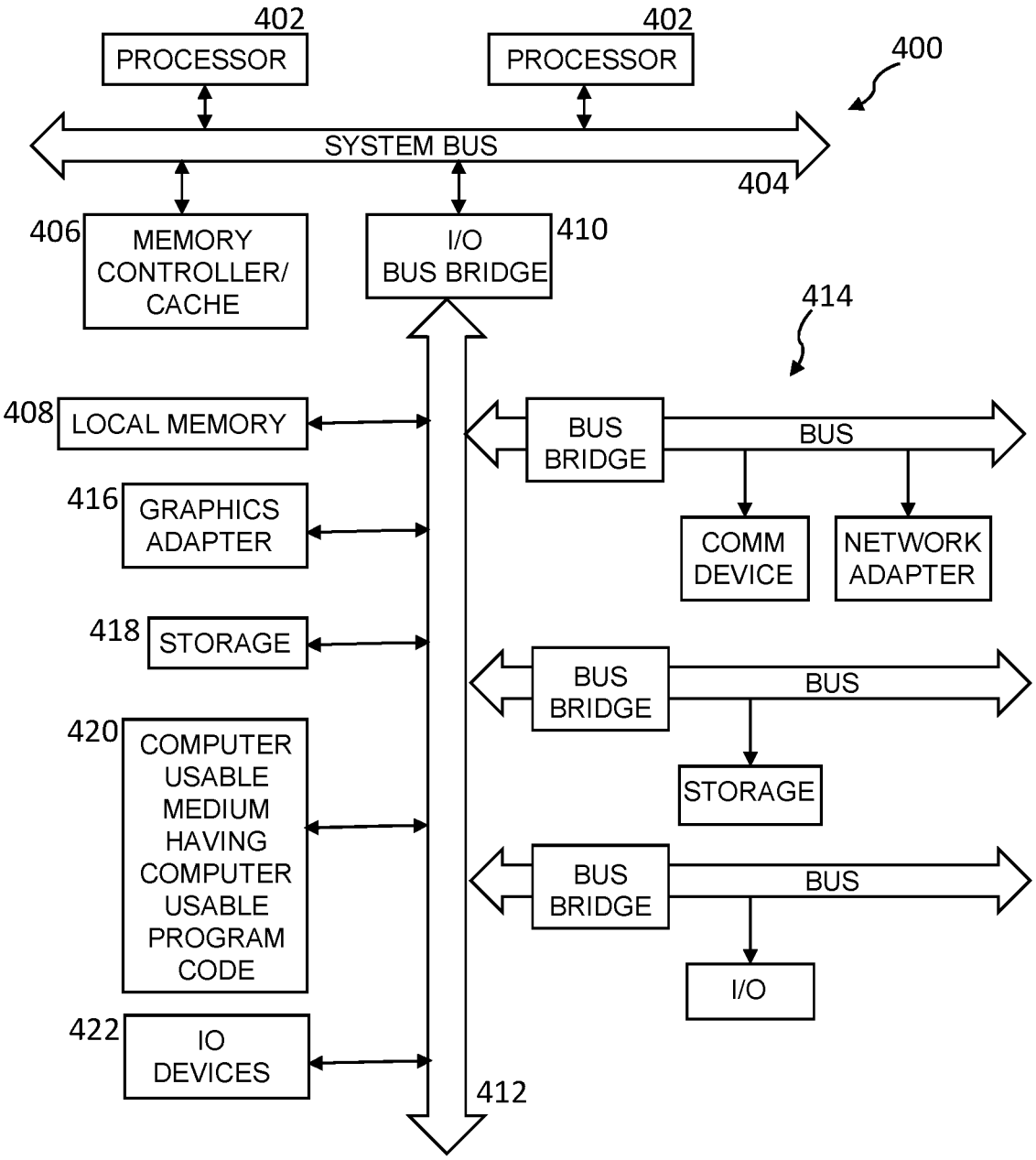
FIG. 3 depicts a block diagram of a data processing system in accordance with the present disclosure.

Referring to FIG. 3, a block diagram of a data processing system is depicted in accordance with the present disclosure. A data processing system 400, such as may be utilized to implement the hardware platform 106 or aspects thereof, e.g., as set out in greater detail in FIG. 1, may comprise a symmetric multiprocessor (SMP) system or other configuration including a plurality of processors 402 connected to system bus 404. Alternatively, a single processor 402 may be employed. Also connected to system bus 404 is memory controller/cache 406, which provides an interface to local memory 408. An I/O bridge 410 is connected to the system bus 404 and provides an interface to an I/O bus 412. The I/O bus may be utilized to support one or more buses and corresponding devices 414, such as bus bridges, input output devices (I/O devices), storage, network adapters, etc. Network adapters may also be coupled to the system to enable the data processing system to become coupled to other data processing systems or remote printers or storage devices through intervening private or public networks.

Also connected to the I/O bus may be devices such as a graphics adapter 416, storage 418 and a computer usable storage medium 420 having computer usable program code embodied thereon. The computer usable program code may be executed to execute any aspect of the present disclosure, for example, to implement aspect of any of the methods, computer program products and/or system components illustrated in FIG. 1 and FIG. 2. It should be appreciated that the data processing system 400 can be implemented in the form of any system including a processor and memory that is capable of performing the functions and/or operations described within this specification. For example, the data processing system 400 can be implemented as a server, a plurality of communicatively linked servers, a workstation, a desktop computer, a mobile computer, a tablet computer, a laptop computer, a netbook computer, a smart phone, a personal digital assistant, a set-top box, a gaming device, a network appliance, and so on.

The data processing system 400, such as may also be utilized to implement the augmented sound system 106 and computer vision system 108, or aspects thereof, e.g., as set out in greater detail in FIG. 1.

While the disclosure concludes with claims defining novel features, it is believed that the various features described herein will be better understood from a consideration of the description in conjunction with the drawings. The process(es), machine(s), manufacture(s) and any variations thereof described within this disclosure are provided for purposes of illustration. Any specific structural and functional details described are not to be interpreted as limiting, but merely as a basis for the claims and as a representative basis for teaching one skilled in the art to variously employ the features described in virtually any appropriately detailed structure. Further, the terms and phrases used within this disclosure are not intended to be limiting, but rather to provide an understandable description of the features described.

For purposes of simplicity and clarity of illustration, elements shown in the figures have not necessarily been drawn to scale. For example, the dimensions of some of the elements may be exaggerated relative to other elements for clarity. Further, where considered appropriate, reference numbers are repeated among the figures to indicate corresponding, analogous, or like features.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart(s) and block diagram(s) in the Figures illustrate the architecture, functionality, and operation of possible implementations of systems, methods, and computer program products according to various embodiments of the present invention. In this regard, each block in the flowchart(s) or block diagram(s) may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "includes," "including," "comprises," and/or "comprising," when used in this disclosure, specify the presence of stated features, integers, steps, operations, elements, and/or components, but do not preclude the presence or addition of one or more other features, integers, steps, operations, elements, components, and/or groups thereof.

Reference throughout this disclosure to "one embodiment," "an embodiment," "one arrangement," "an arrangement," "one aspect," "an aspect," or similar language means that a particular feature, structure, or characteristic described in connection with the embodiment is included in at least one embodiment described within this disclosure. Thus, appearances of the phrases "one embodiment," "an embodiment," "one arrangement," "an arrangement," "one aspect," "an aspect," and similar language throughout this disclosure may, but do not necessarily, all refer to the same embodiment.

The term "plurality," as used herein, is defined as two or more than two. The term "another," as used herein, is defined as at least a second or more. The term "coupled," as used herein, is defined as connected, whether directly without any intervening elements or indirectly with one or more intervening elements, unless otherwise indicated. Two elements also can be coupled mechanically, electrically, or communicatively linked through a communication channel, pathway, network, or system. The term "and/or" as used herein refers to and encompasses any and all possible combinations of one or more of the associated listed items. It will also be understood that, although the terms first, second, etc. may be used herein to describe various elements, these elements should not be limited by these terms, as these terms are only used to distinguish one element from another unless stated otherwise or the context indicates otherwise.

The term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method comprising:

receiving, by a computer, an identification of an object within a physical environment that is both proximate a user and separate from the user and a speaker array;

determining, by the computer, a location of the object within the physical environment;

determining, by the computer, a current location of the user within the physical environment;

causing, by the computer, the speaker array to produce a sound based on the location of the object and the current location of the user such that the sound appears, relative to the current location of the user, to originate from the location of the object;

detecting, by the computer, a respective location of a plurality of objects within the physical environment;

determining, by the computer, a plurality of positions within the physical environment; and for each of the plurality of objects and each of the plurality of positions:

determining a respective operational mode of the speaker array to produce a particular sound such that the particular sound appears, relative the position, to originate from the object, wherein the speaker array includes a directional speaker array configured to bounce ultrasonic signals off the plurality of objects to create the sound that appears, relative to the current location of the user, to originate from the location of the object, the respective operational mode for each of the plurality of objects and each of the plurality of positions is used to drive the directional speaker array to produce a respective bounce pattern, and the respective bounce patterns are determined using an investigation mode of the computer.

2. The method of claim 1, wherein determining the location of the object comprises:

detecting the object in an image of the physical environment; and determining a current location of the object within the physical environment based on the image.

3. The method of claim 1, further comprising:
associating, by the computer, a first category of sounds with a first corresponding object; and
associating, by the computer, a second category of sounds with a second corresponding object.

4. The method of claim 1, further comprising:
receiving, by the computer from a sound producing technology, a request with information comprising the identification of the object.

5. The method of claim 4, wherein the sound producing technology comprises at least one of: an artificial intelligent assistant, a virtual reality system, an augmented reality system, or an entertainment system.

6. The method of claim 4, wherein the request comprises data representing the sound.

7. The method of claim 1, further comprising:
identifying, by the computer, a one sound source location within the physical environment;
identifying, by the computer, a one sound receiving location within the physical environment;
causing, by the computer, the speaker array to operate in a plurality of operational modes to produce a corresponding sound; and
determining, by the computer, a one of the operational modes in which the corresponding sound appears, relative to the one sound receiving location, to originate from the one sound source location.

8. The method of claim 7, further comprising:
determining, by the computer, a respective operation mode for each of a plurality of pairs of sound source locations and sound receiving locations.

9. The method of claim 8, further comprising:
selecting, by the computer, one of the respective operation modes based on the current location of the object and the current location of the user.

10. A system, comprising:
a computer including a processor programmed to initiate executable operations comprising:
receiving an identification of an object within a physical environment that is both proximate a user and separate from the user and a speaker array;
determining, by the computer, a location of the object within the physical environment;
determining a current location of the user within the physical environment; and
causing the speaker array to produce a sound based on the location of the object and the current location of the user such that the sound appears, relative to the current location of the user, to originate from the location of the object;
detecting, by the computer, a respective location of a plurality of objects within the physical environment;
determining, by the computer, a plurality of positions within the physical environment; and
for each of the plurality of objects and each of the plurality of positions:
determining a respective operational mode of the speaker array to produce a particular sound such that the particular sound appears, relative the position, to originate from the object, wherein
the speaker array includes a directional speaker array configured to bounce ultrasonic signals off the plurality of objects to create the sound that appears, relative to the current location of the user, to originate from the location of the object,
the respective operational mode for each of the plurality of objects and each of the plurality of positions is used to drive the directional speaker array to produce a respective bounce pattern, and
the respective bounce patterns are determined using an investigation mode of the computer.

11. The system of claim 10, wherein determining the location of the object comprises:
detecting the object in an image of the physical environment; and
determining a current location of the object within the physical environment based on the image.

12. The system of claim 10, wherein the processor is programmed to initiate executable operations further comprising:
associating, by the computer, a first category of sounds with a first corresponding object; and
associating, by the computer, a second category of sounds with a second corresponding object.

13. The system of claim 10, wherein the processor is programmed to initiate executable operations further comprising:
receiving, by the computer from a sound producing technology, a request with information comprising the identification of the object.

14. The system of claim 4, wherein the sound producing technology comprises at least one of: an artificial intelligent assistant, a virtual reality system, an augmented reality system, or an entertainment system.

15. The system of claim 4, wherein the request comprises data representing the sound.

16. The system of claim 10, wherein the processor is programmed to initiate executable operations further comprising:
identifying, by the computer, a one sound source location within the physical environment;
identifying, by the computer, a one sound receiving location within the physical environment;
causing, by the computer, the speaker array to operate in a plurality of operational modes to produce a corresponding sound; and
determining, by the computer, a one of the operational modes in which the corresponding sound appears, relative to the one sound receiving location, to originate from the one sound source location.

17. The system of claim 16, wherein the processor is programmed to initiate executable operations further comprising:
determining, by the computer, a respective operation mode for each of a plurality of pairs of sound source locations and sound receiving locations.

18. A computer program product, comprising:
a computer readable storage medium having program code stored thereon, the program code executable by a data processing system to initiate operations including:
receiving, by the data processing system, an identification of an object within a physical environment that is both proximate a user and separate from the user and a speaker array;
determining, by the data processing system, a location of the object within the physical environment;
determining, by the data processing system, a current location of the user within the physical environment; and
causing, by the data processing system, the speaker array to produce a sound based on the location of the object and the current location of the user such that the sound appears, relative to the current location of the user, to originate from the location of the object;

detecting, by the data processing system, a respective location of a plurality of objects within the physical environment;

determining, by the data processing system, a plurality of positions within the physical environment; and for each of the plurality of objects and each of the plurality of positions:

determining a respective operational mode of the speaker array to produce a particular sound such that the particular sound appears, relative the position, to originate from the object, wherein the speaker array includes a directional speaker array configured to bounce ultrasonic signals off the plurality of objects to create the sound that appears, relative to the current location of the user, to originate from the location of the object, the respective operational mode for each of the plurality of objects and each of the plurality of positions is used to drive the directional speaker array to produce a respective bounce pattern, and the respective bounce patterns are determined using an investigation mode of the computer.

19. The method of claim 1, wherein the speaker array is positioned away from and separate from the computer and the user.

20. The system of claim 10, wherein the speaker array is positioned away from and separate from the computer and the user.

* * * * *